US005599229A

United States Patent [19]

Claunch et al.

[11] Patent Number: 5,599,229

[45] Date of Patent: Feb. 4, 1997

[54] ENHANCEMENT OF WALL JET TRANSPORT PROPERTIES

[75] Inventors: Scott D. Claunch, Broomfield; Robert B. Farrington, Golden, both of Colo.

[73] Assignee: Midwest Research Institute, Kansas City, Mo.

[21] Appl. No.: 436,144

[22] Filed: May 8, 1995

[51] Int. Cl.[6] ..... B60S 1/54

[52] U.S. Cl. ..... 454/121; 34/492; 34/632; 454/127

[58] Field of Search ..... 34/492, 632; 454/85, 454/93, 121, 125, 127, 198

[56] References Cited

U.S. PATENT DOCUMENTS

| | | | |
|---|---|---|---|
| 681,215 | 8/1901 | Goll . | |
| 2,212,468 | 8/1940 | Ferris . | |
| 2,972,358 | 2/1961 | Hinden | 138/39 |
| 3,242,846 | 3/1966 | Bunn . | |
| 3,346,932 | 10/1967 | Cheape, Jr. | 34/632 X |
| 3,624,806 | 11/1971 | Lytzen | 34/624 X |
| 3,777,651 | 12/1973 | Hansen . | |
| 3,815,485 | 6/1974 | Beusink et al. . | |
| 3,832,939 | 9/1974 | Kakei et al. | 454/125 |
| 3,927,827 | 12/1975 | Strindehag . | |
| 4,055,003 | 10/1977 | Sack | 34/632 |
| 4,413,550 | 11/1983 | Piano . | |
| 4,823,681 | 4/1989 | Gore . | |
| 4,875,624 | 10/1989 | Hara et al. | 236/49.5 |
| 4,941,398 | 7/1990 | Morris et al. | 454/125 X |
| 5,338,254 | 8/1994 | Farrington | 454/284 |

OTHER PUBLICATIONS

Conveney D. et al., *Papermaking and Paperboard Making*, 2nd., 3:405–551, pp. 414–484 (1970).

*Primary Examiner*—Harold Joyce
*Attorney, Agent, or Firm*—Edna M. O'Connor

[57] ABSTRACT

By enhancing the natural instabilities in the boundary layer and in the free shear layer of a wall jet, the boundary is minimized thereby increasing the transport of heat and mass. Enhancing the natural instabilities is accomplished by pulsing the flow of air that creates the wall jet. Such pulsing of the flow of air can be accomplished by sequentially occluding and opening a duct that confines and directs the flow of air, such as by rotating a disk on an axis transverse to the flow of air in the duct.

20 Claims, 15 Drawing Sheets

ENHANCEMENT OF WALL JET TRANSPORT PROPERTIES

The United States Government has rights in this invention under Contract No. DE-AC3683CH10093 between the U.S. Department of Energy and the National Renewable Energy Laboratory, a Division of Midwest Research Institute.

BACKGROUND OF INVENTION

1. Field of Invention

The present invention relates generally to the mechanism of heat and mass transfer and more particularly to a method and apparatus for enhancing the natural instabilities in the boundary layer and free shear layer of a stream of fluid that flows along a solid surface.

2. Description of the State of Art

Heating, ventilation, and air conditioning (HVAC) systems introduce or inject air into a room through narrow, elongated nozzles or air diffusers to produce a substantially planar (narrow, elongated) jet or free jet of air. The emerging jet is the primary motion in the air diffusion process. However, as the jet entrains mass from the ambient room air it induces a secondary room air motion because the entrained mass is replaced by adjacent air. Therefore, the secondary room air motion is the mechanism by which ambient air, which carries potentially harmful pollutants, is brought to the jet where it is diluted by mixing and eventually removed in the return air. Farrington in U.S. Pat. No. 5,338,254 disclosed that the mixing properties of a free jet may be increased by imparting periodic pressure pulsations to an air flow upstream of the jet outlet so that the frequency of the pulsations matched the natural characteristic frequency of a turbulence in the free jet emerging from an air diffuser. This process has been found to be an effective way to achieve a high degree of mixing, of the incoming air with the ambient air in a room.

In addition to the mixing, entrainment, and spreading properties that exist for a free jet, heat and mass transport properties exist for another flow phenomena, referred to as a wall jet. The term "wall jet", as described by Bakke P., J. *Fluid Mechanics,* 2:467 (1957), refers to the flow field created "when a jet, consisting of a fluid similar to that of its surroundings, impinges on a plane surface and spreads out over the surface."

There are three basic means by which heat transfer can occur: convection, conduction, and radiation. Convection, refers to the transfer of heat between a body and a fluid, and takes place primarily by interchanging the physical position of molecules. This is the primary means of air drying. Whereas, the transfer of heat by conduction involves the interchange of kinetic energy between molecules without displacing molecules. Obviously, convective heat transfer involves flow phenomena, such that, heat transfer is governed by the fluid-flow characteristics 10, of the system, as shown in FIG. 1.

In general as a fluid F or collectively a jet J, emerges from outlet 12, a free shear layer 14 develops at the free edge 16 of the jet J, and a boundary layer 18 develops at the plane surface S, such as, the surface of a paper, textile, wall, window, or ceiling. Each of these layers 14 and 18 grow and at some point P downstream they meet. The region near outlet 12, where the two viscous layers 14 and 18 have not yet propagated all the way across the flow in the transverse direction, is the inviscid or potential core region 20 where local velocities between the free shear layer 14 and boundary layer 18 are unaffected by viscosity.

In free shear layer 14, turbulent structures 22 form due to instabilities that result from the steep velocity gradients and associated viscous effects. These turbulent structures 22 form an array of large-scale vortices which entrain mass. Farther downstream, the vortical structures interact by pairing, coalescing, and tearing and are eventually broken down by viscous diffusion until complete mixing has occurred.

Within boundary layer 18, fluid molecules that come in contact with surface S remain essentially stationary (with respect to surface S), a condition referred to as no-slip, while molecules in jet J move with the velocity of jet J. Between these two extremes, layers of molecules move at intermediate velocities as the fluid shears (molecules slipping past one another). This region of shear as a whole is known as the boundary layer. At low velocities, each individual layer of molecules present in boundary layer 18 slips past the adjacent layers without significant interchange of molecules between layers. Under this condition boundary layer 18 is described as laminar. At higher velocities, boundary layer 18 becomes turbulent, although a portion of it known as the laminar sublayer 24, remains in the laminar regime.

Mass transfer, just as heat transfer, is also dependent on the flow characteristics of the air. Through laminar layers, mass transfer is controlled by molecular diffusion, while through turbulent portions of the boundary layer, it is controlled by eddy or convective, diffusion. Molecular diffusion, which involves the interchange of position, molecule by molecule, is a relatively slow process. On the other hand, eddy diffusion involves a rapid relocation of molecules by turbulent motion. Thus, as with heat transfer, laminar sublayer 24 is a critical element of mass transfer.

The efficiency and overall effectiveness of heat and mass transport are properties of significant importance in many industries concerned with the removal of moisture from a substance or the cooling of a substance. For example, wall jets are utilized in the automotive industry, for purposes of defogging automobile windshields, in the paper and textile industries for purposes of evaporating moisture and in the glass and metal industries for cooling sheets or processed glass and metal.

For example, paper, to be useful, normally requires a moisture content of less than 0.1 lb water/lb paper. However, after pressing, the sheet still contains from 1 to 3 lb water/lb finished paper, depending on the particular machine and product. Since no particular method of direct liquid extraction has been developed to reduce the moisture content below the level of 1 lb/lb finished paper, it is necessary to resort to the relatively expensive process of evaporation. One mechanism commonly utilized in the evaporation process is air drying. In the air drying process, air serves as the medium for both heat and mass transfer. The heat for evaporation is applied to the sheet by convective heat transfer from the air surrounding the sheet, then evaporated moisture diffuses into this air and is ultimately carried away by it.

In air drying, the sheet can be considered as the solid, while air is the flowing fluid. Therefore, "[f]or overall convection heat transfer in air drying, heat flows through the laminar sublayer [24] by conduction, while through the turbulent portion of the boundary layer [18] it flows primarily by convection. Since conduction heat transfer through air is very inefficient (air being one of the best insulators known to man) while heat transfer by air convection is much more efficient, laminar sublayer [24] controls the overall rate of heat transfer. Thus the thickness of laminar sublayer [24] is all-important to efficient heat transfer" (emphasis added). See, Coveney D., et at., *Paper Making and Paperboard Making,* 2nd ed., 3:405–551, 464 (1970).

"The need to improve the efficiency of air drying has led to the use of high-velocity and high-temperature air jets impinging directly on the sheet. By impinging the air at high velocity against the sheet, the boundary-layer thickness is minimized, thereby improving both heat and mass transfer . . . All impinging air dryers use air jets generally perpendicular to the web." Id. at 467. High velocity, high-temperature impingement air drying requires large power outputs and can not be used on lighter grades of paper. If the boundary-layer thickness could be minimized, without the requirement of high-velocity, high-temperature impingement, heat and mass transport would be enhanced leading to a more efficient and cost effective means of air drying.

SUMMARY OF THE INVENTION

Accordingly, it is a general object of this invention to provide a method for increasing the transport properties of a wall jet both at and between the solid and free surfaces.

A more specific object of the invention is to modify the boundary layer and free shear layer of a wall jet as it attaches to a plane surface, thus increasing both heat and mass transfer from the plane surface and mixing of ambient air.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

To achieve the foregoing and other objects and in accordance with the purposes of the present invention, as embodied and broadly described therein, the method of this invention may comprise an apparatus and method for enhancing the natural instabilities in the boundary layer and the free shear layer of a wall jet, thereby increasing the transport of heat and mass from a solid surface. Such enhancement can be created, for example, by rotating a disk within a conduit about an axis perpendicular to a flow of the fluid in a duct upstream of the wall jet, thereby creating pulsed pressure variations in the flow of fluid that extends into the jet as it attaches to a plane surface.

BRIEF DESCRIPTION OF THE DRAWINGS

The file of this patent contains at: least one drawing executed in color. Copies of this patent with color photographs will be provided by the United States Patent and Trademark Office upon request and payment of the necessary fee.

The accompanying drawings, which are incorporated in and form a part of the specifications, illustrate the preferred embodiments of the present invention, and together with the descriptions serve to explain the principles of the invention. For the purposes of FIGS. 7–16, the Strouhal number is defined as the frequency times the width of the nozzle divided by the exit velocity.

In the drawings:

FIG. 1 is a schematic cross-sectional representation of a wall jet;

FIG. 2 is a perspective view of a jet excitation system and its placement according to the present invention necessary to simultaneously enhance natural instabilities in the boundary layer and the free shear layer of a wall jet;

Figure 2:
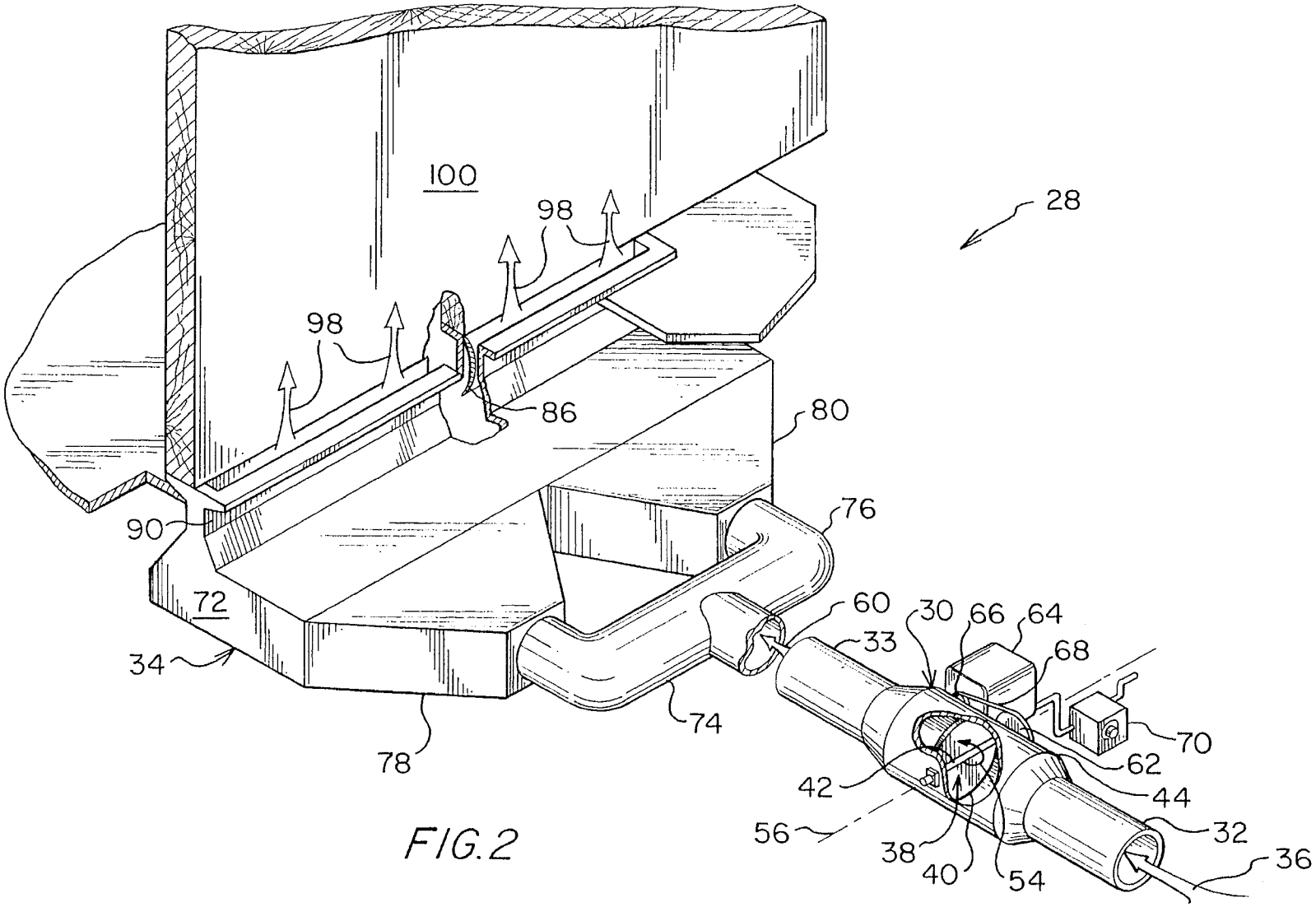
Figure 2A:
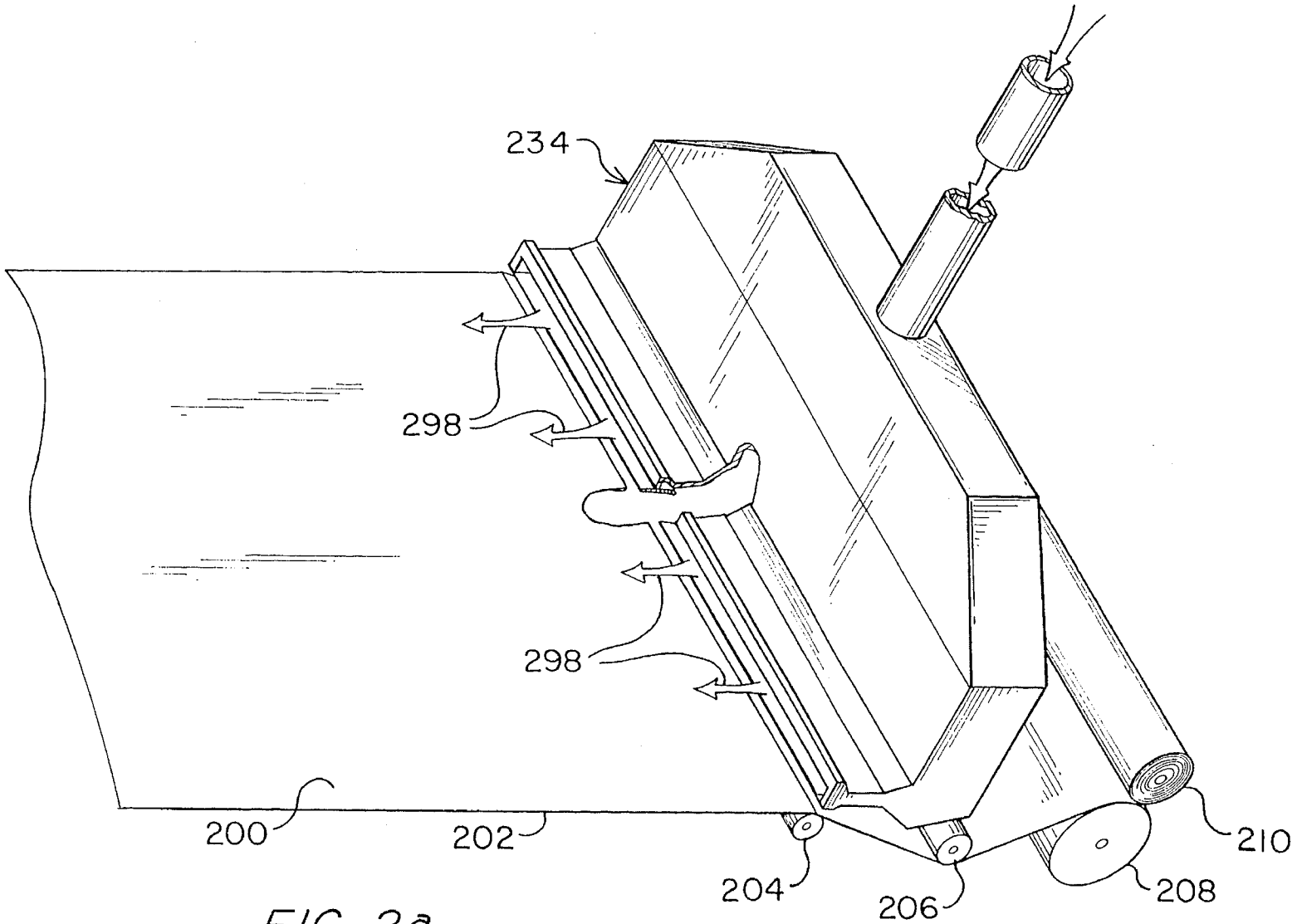
Figure 3:
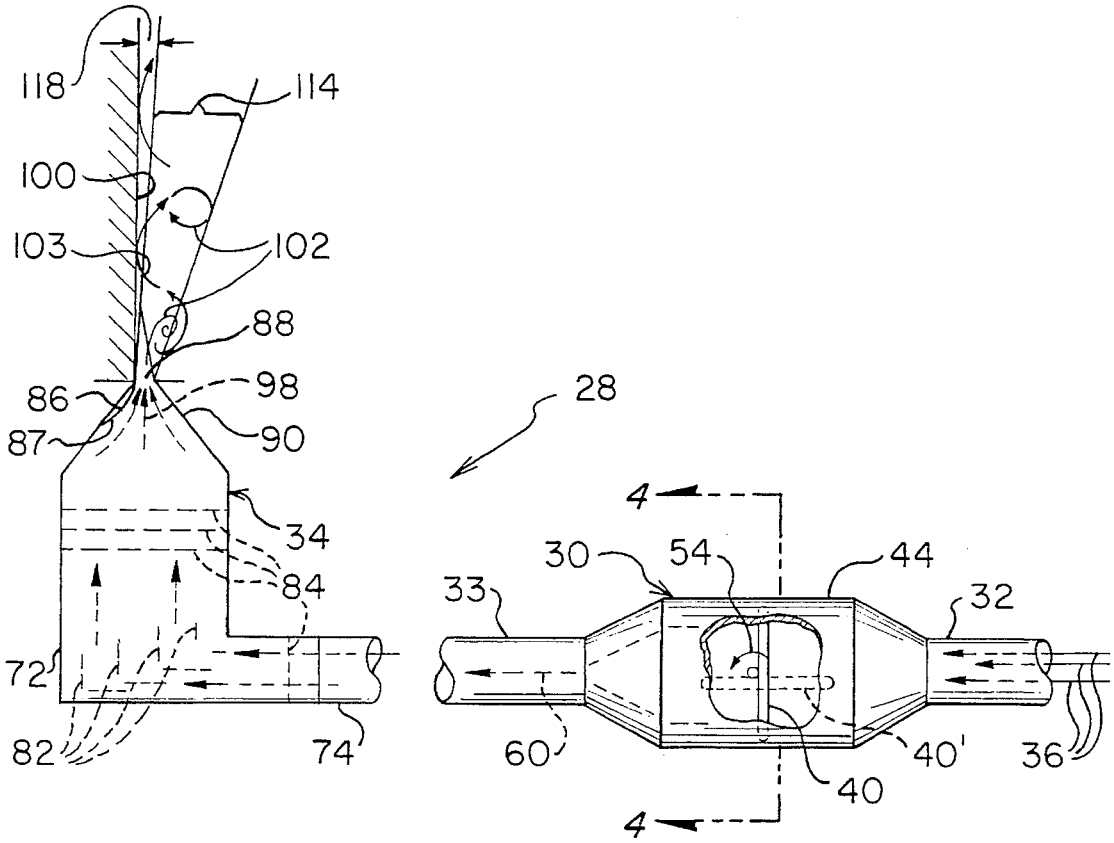
Figure 4:
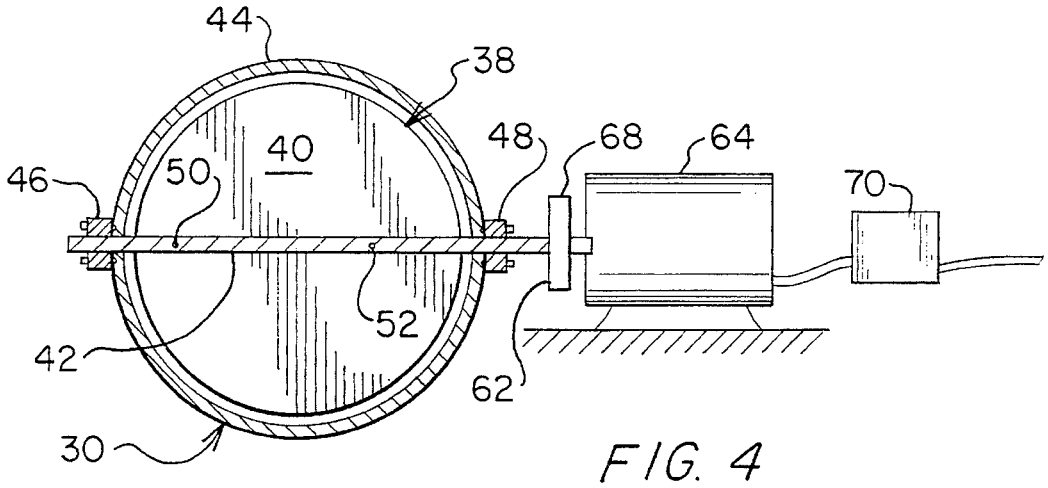
Figure 5:
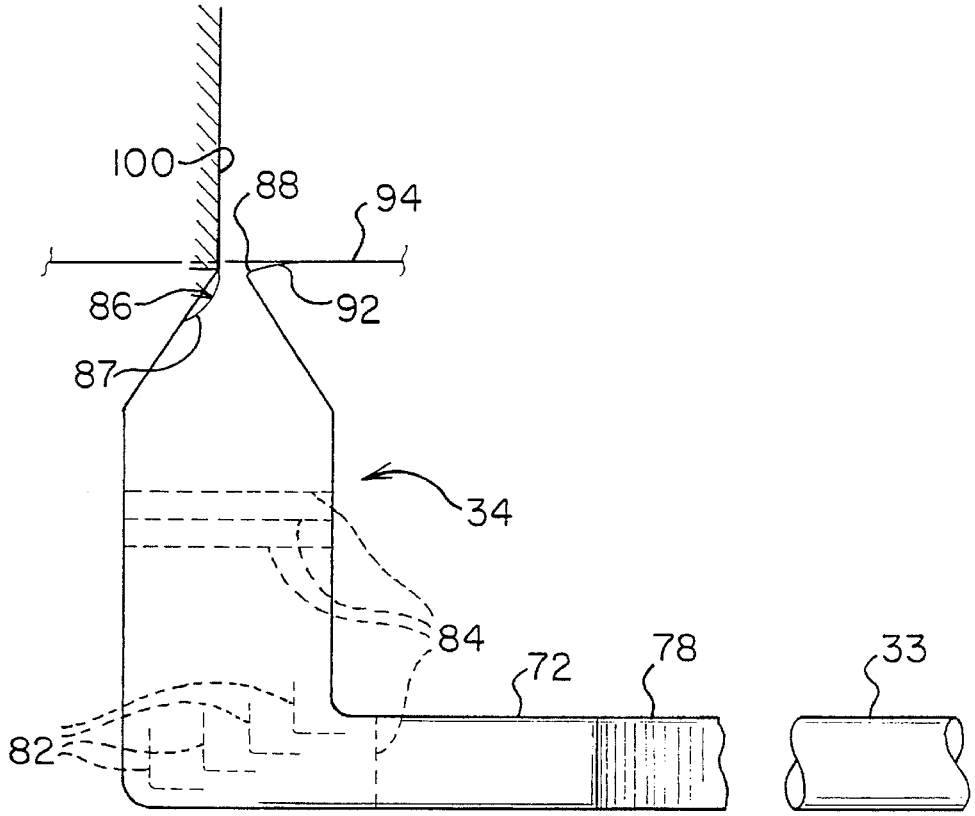
Figure 6:
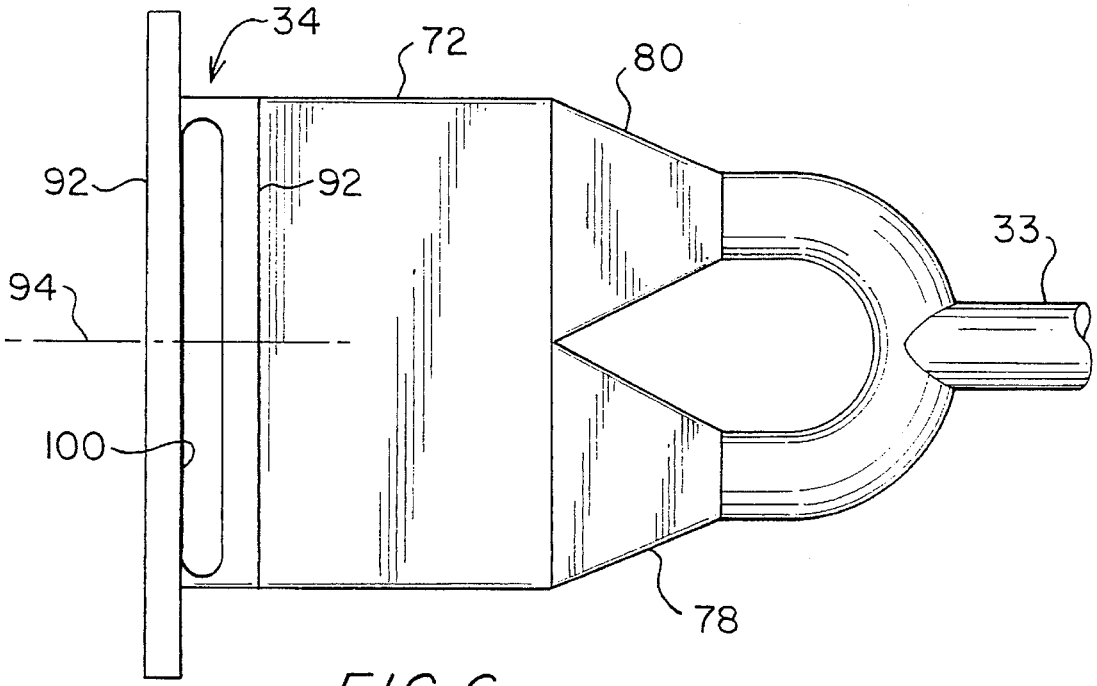
Figure 7:
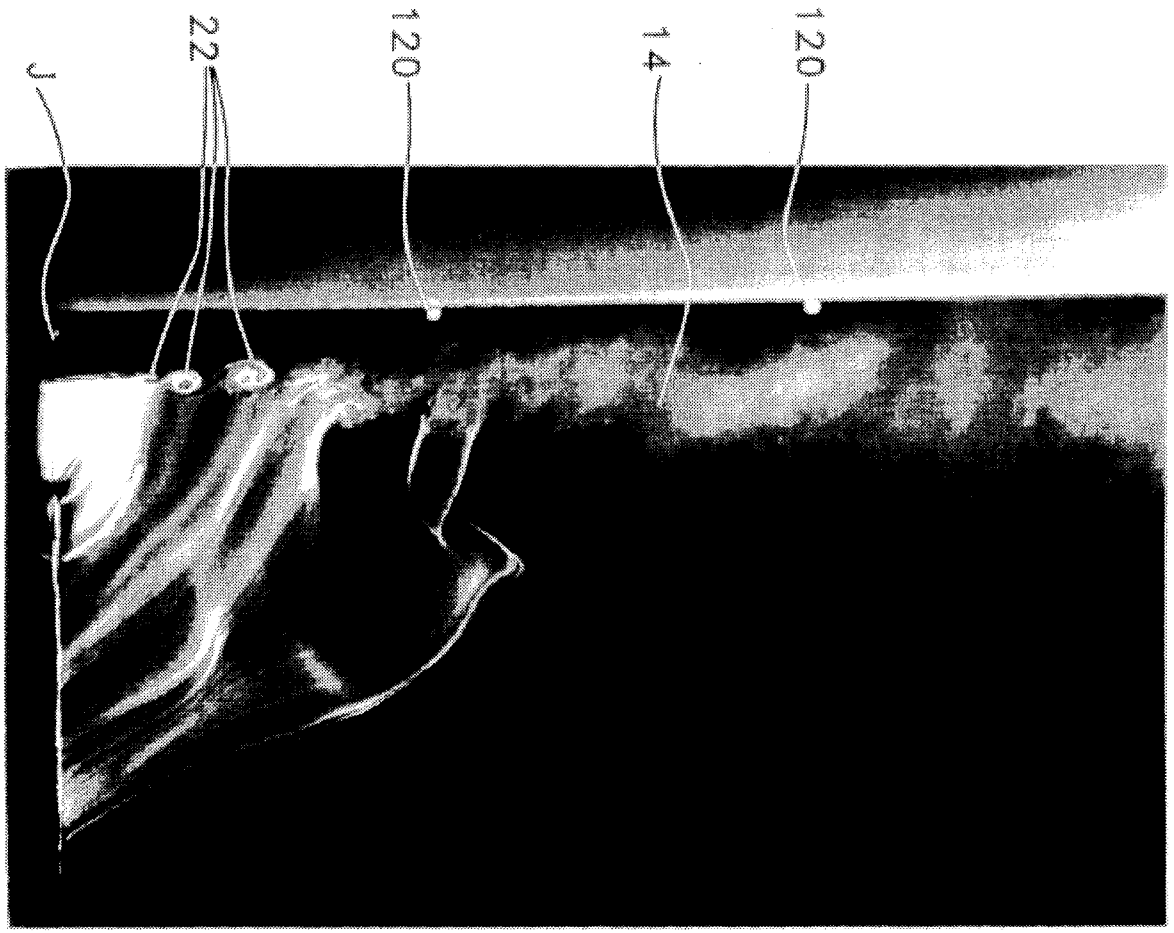
FIG. 7 (PRIOR ART)
Figure 8:
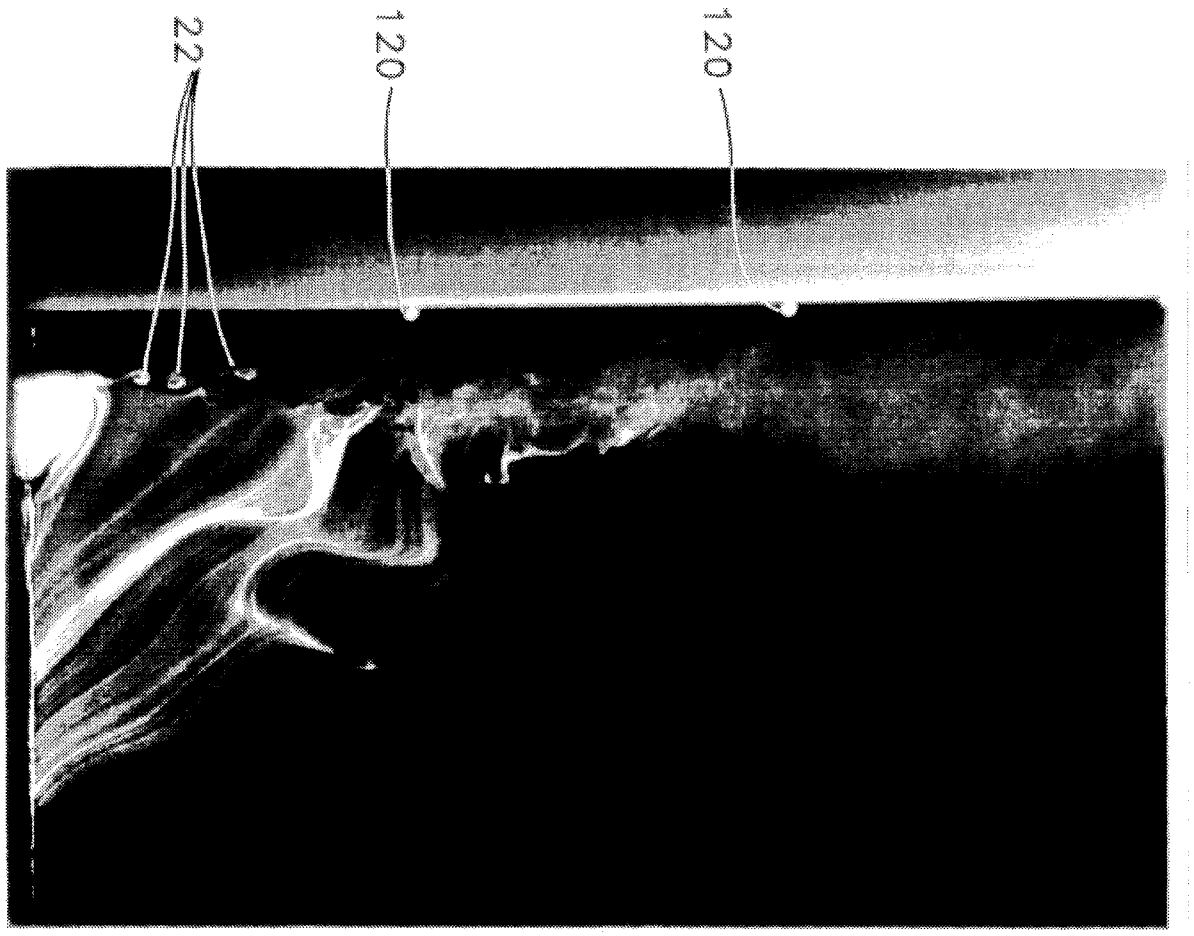
FIG. 8 (PRIOR ART)
Figure 9:
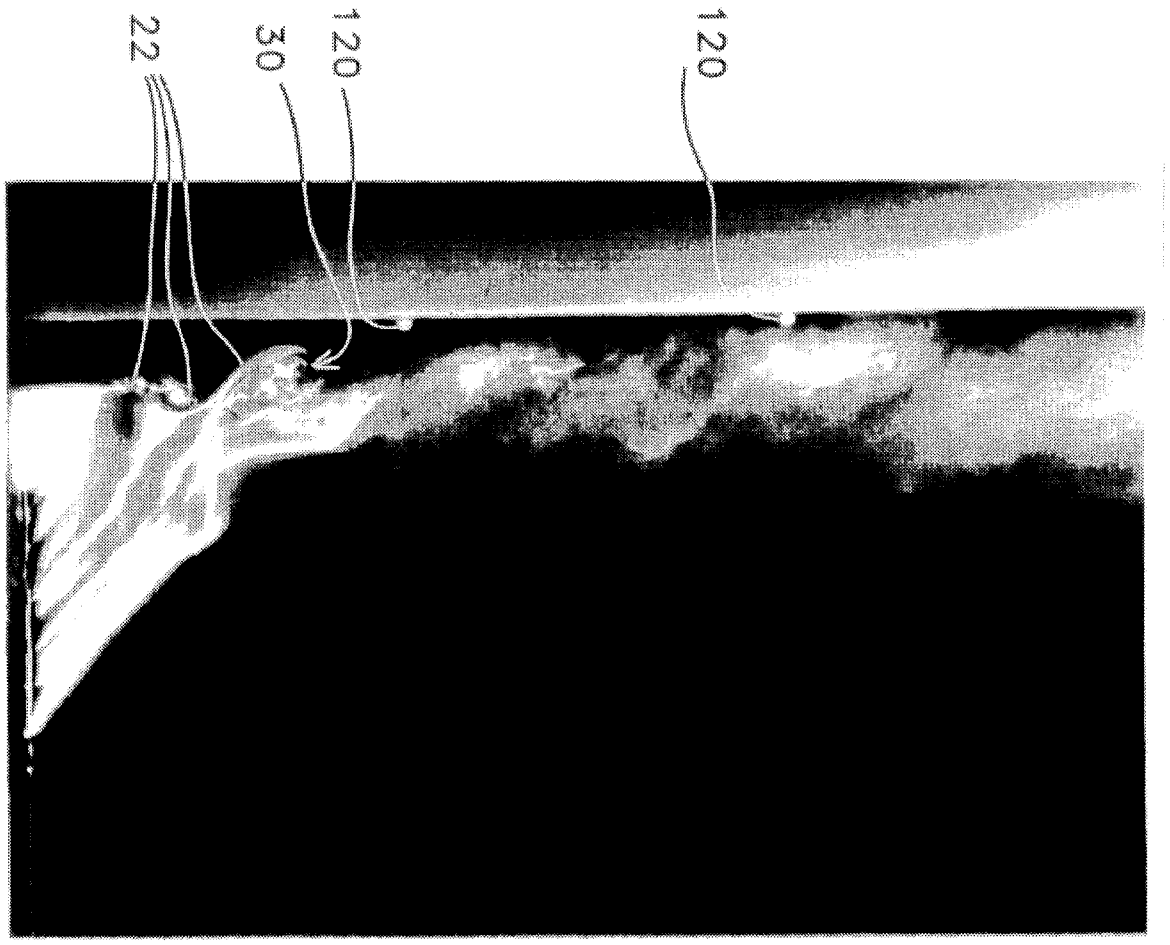
FIG. 9 (PRIOR ART)
Figure 10:
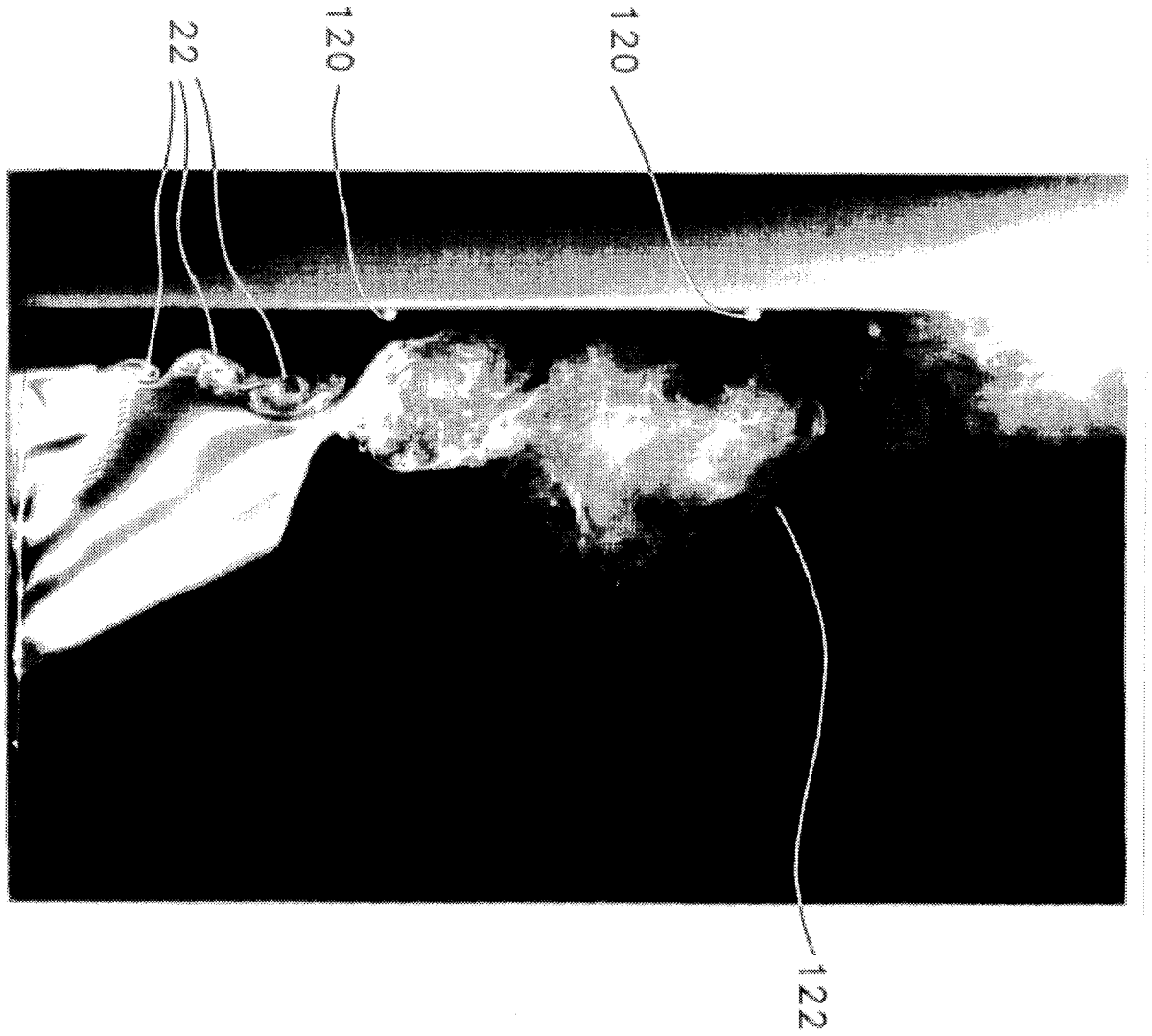
Figure 11:
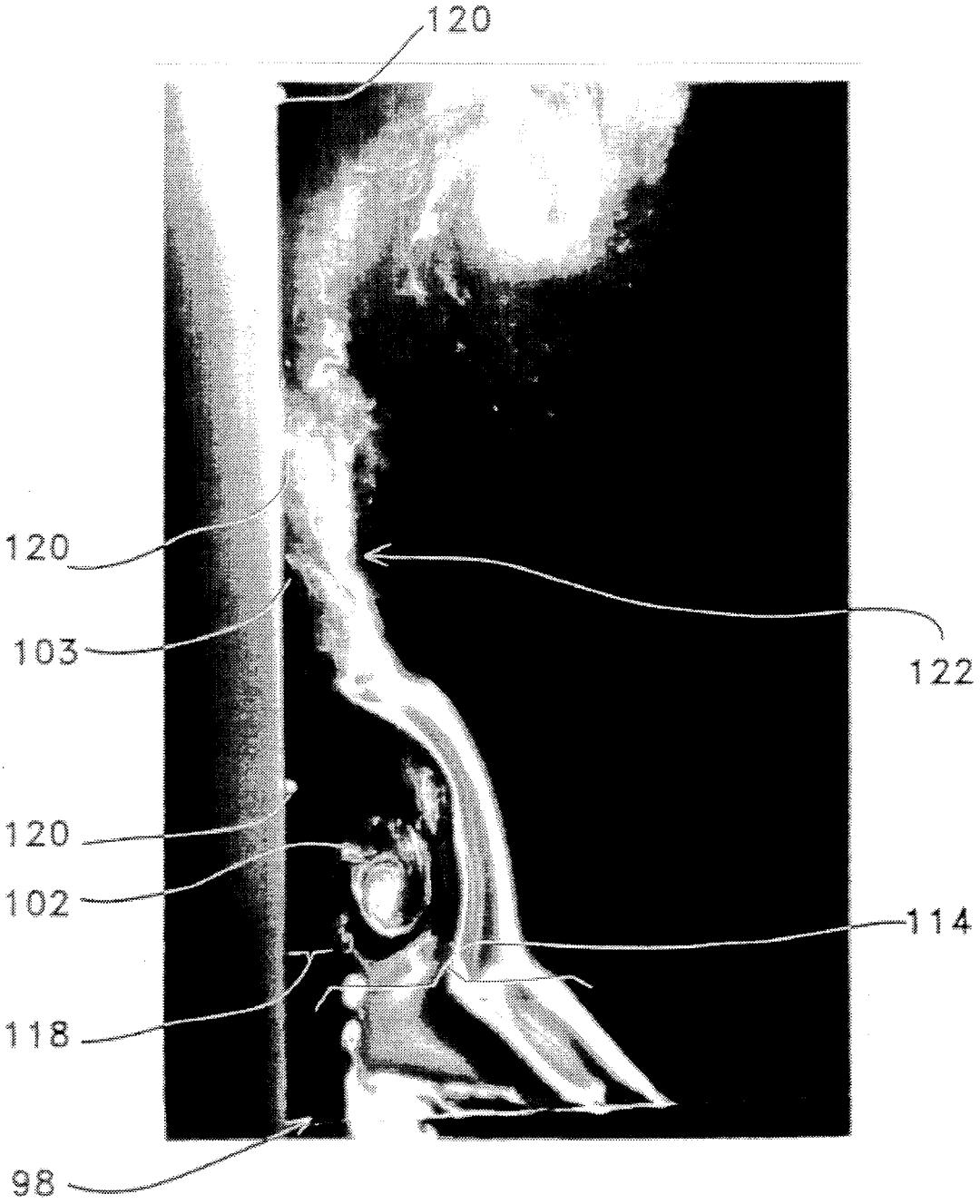
Figure 12:
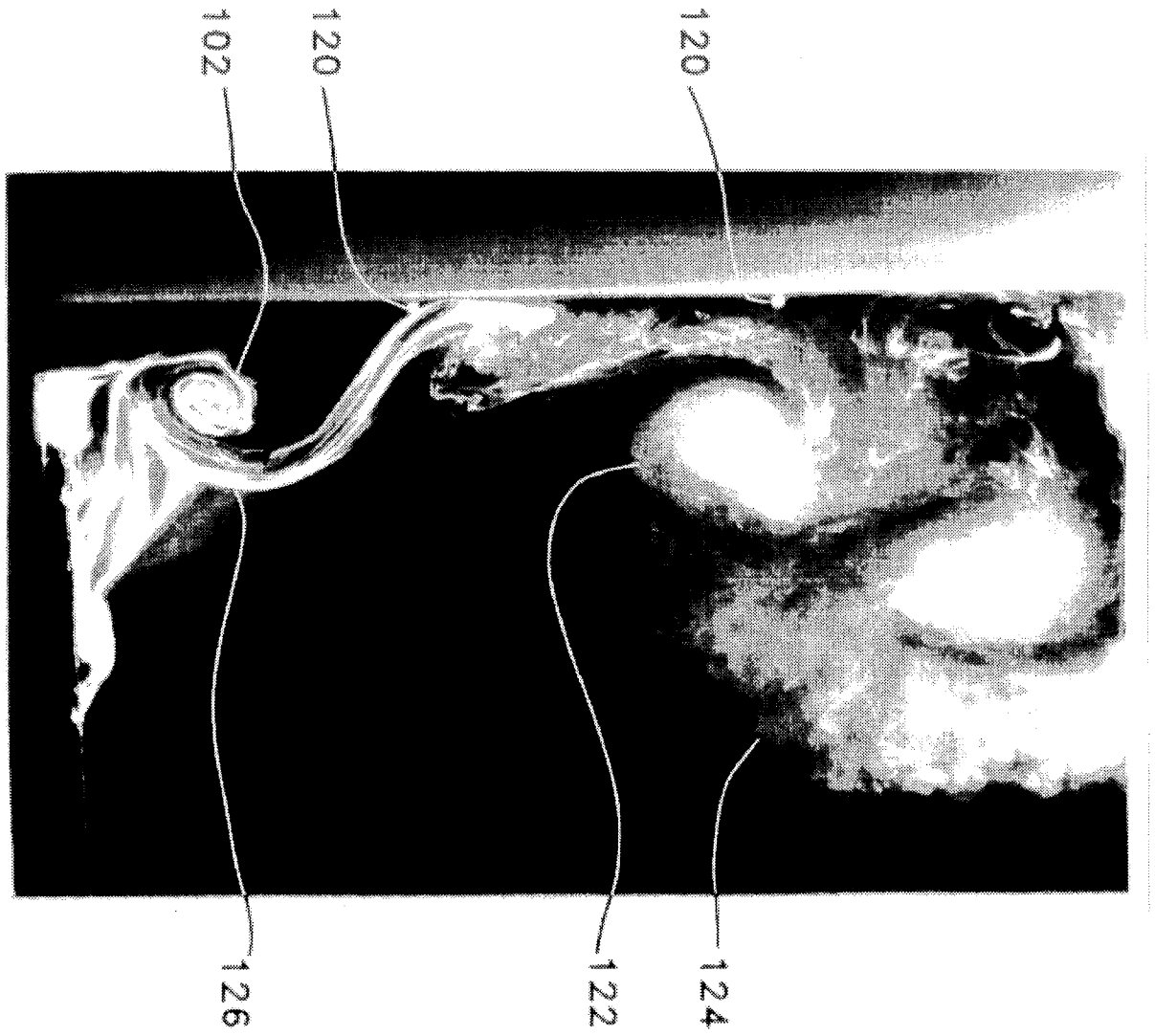
Figure 13:
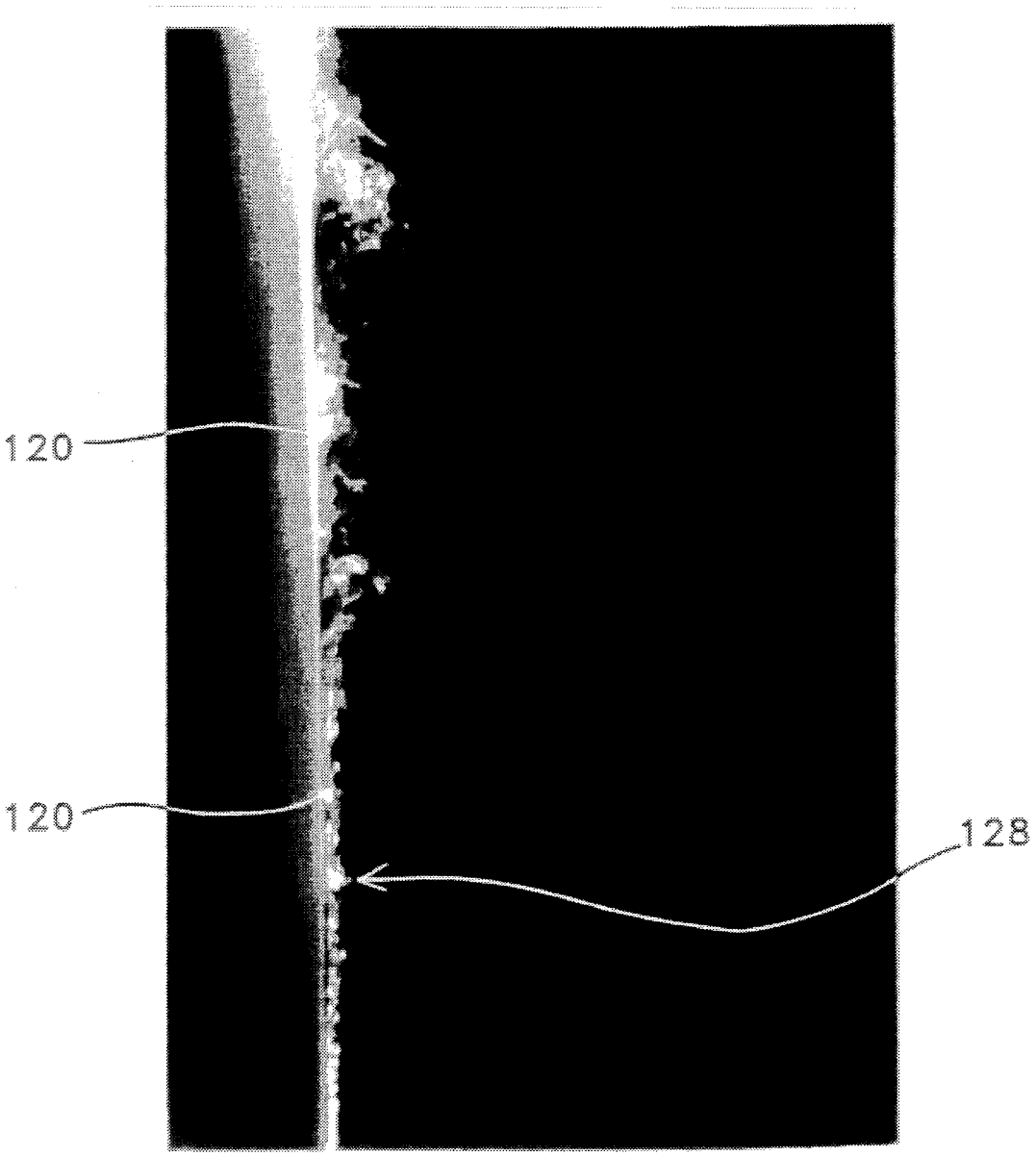
FIG. 13 (PRIOR ART)
Figure 14:
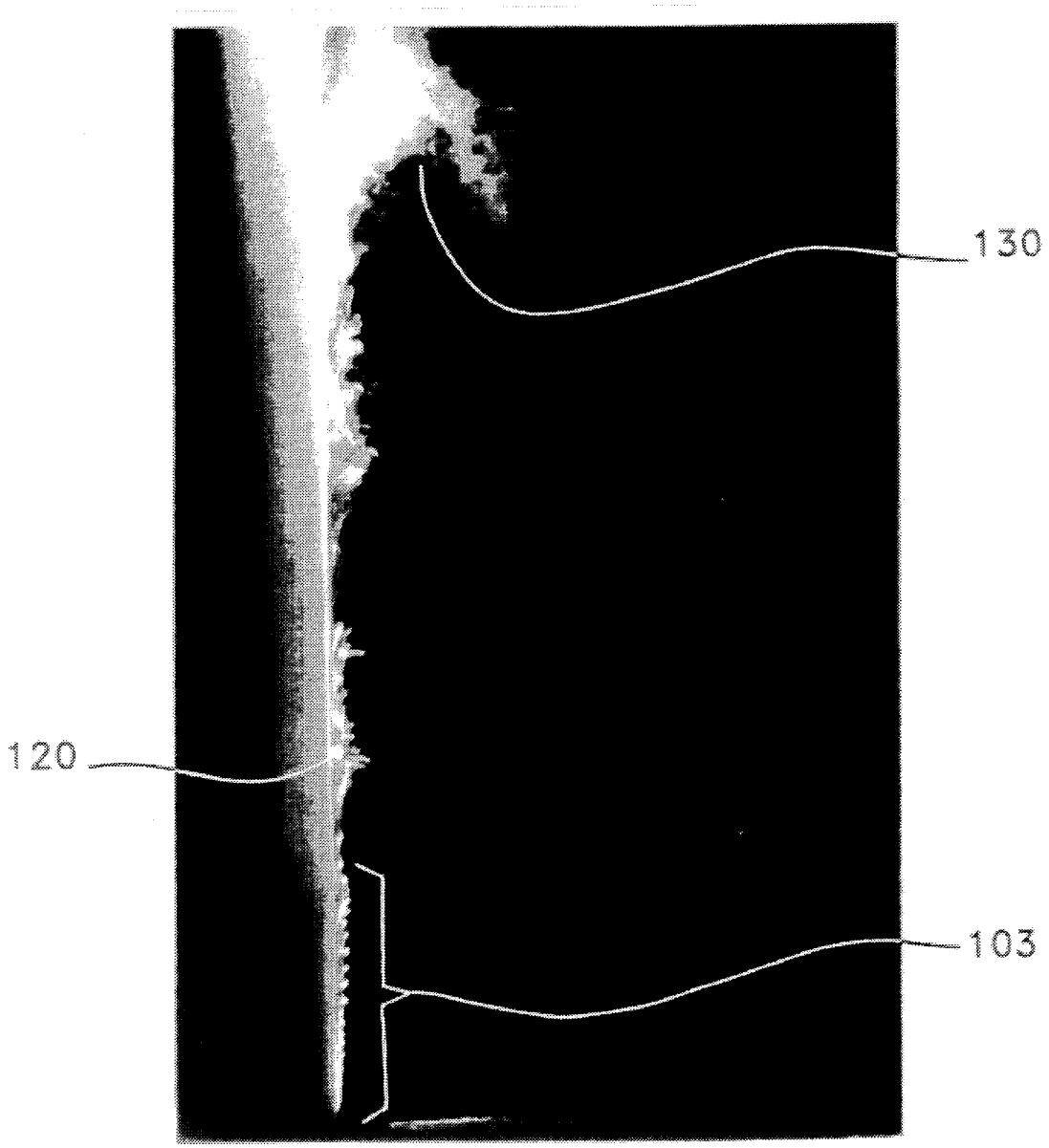
Figure 15:
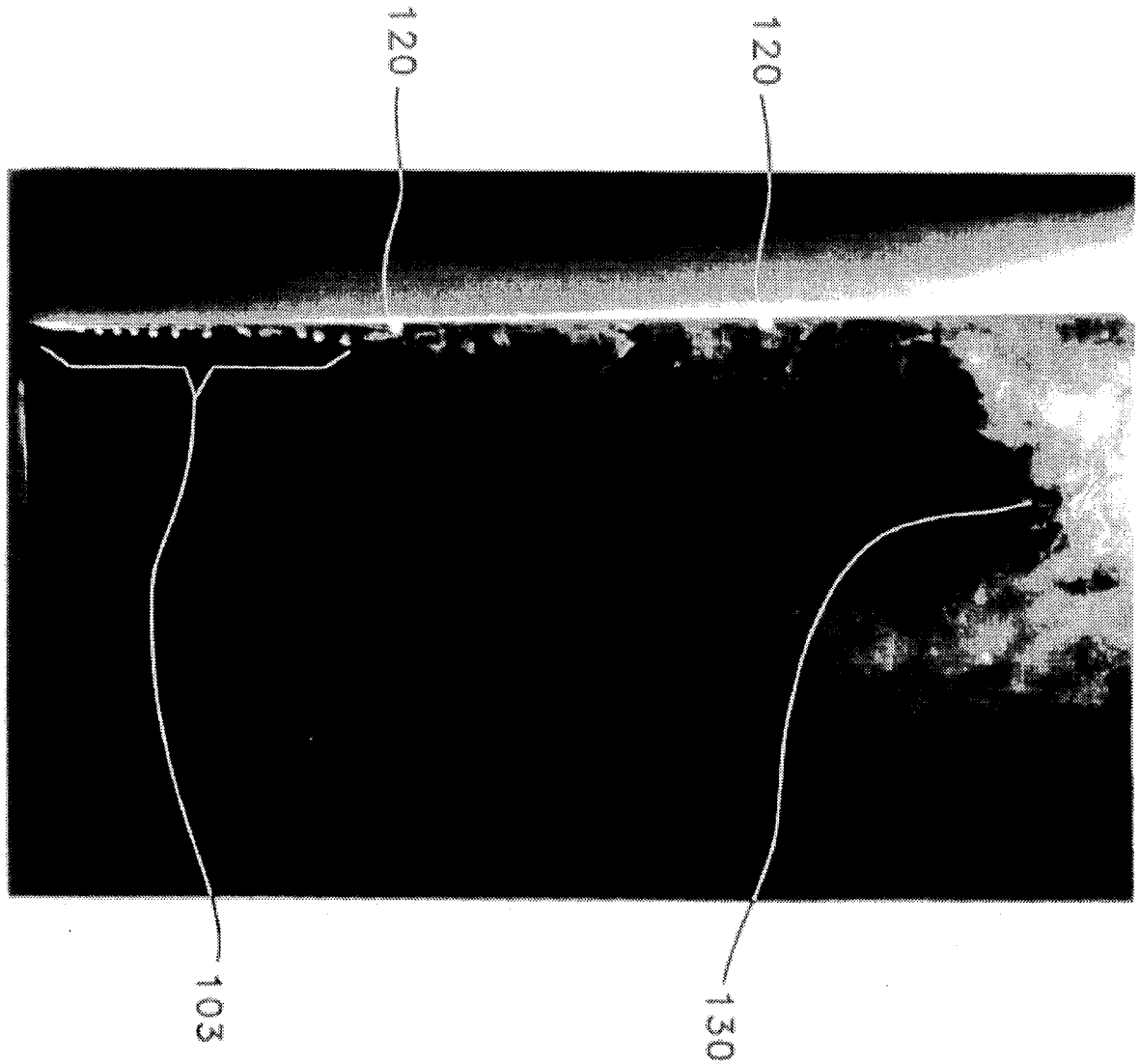
Figure 16:
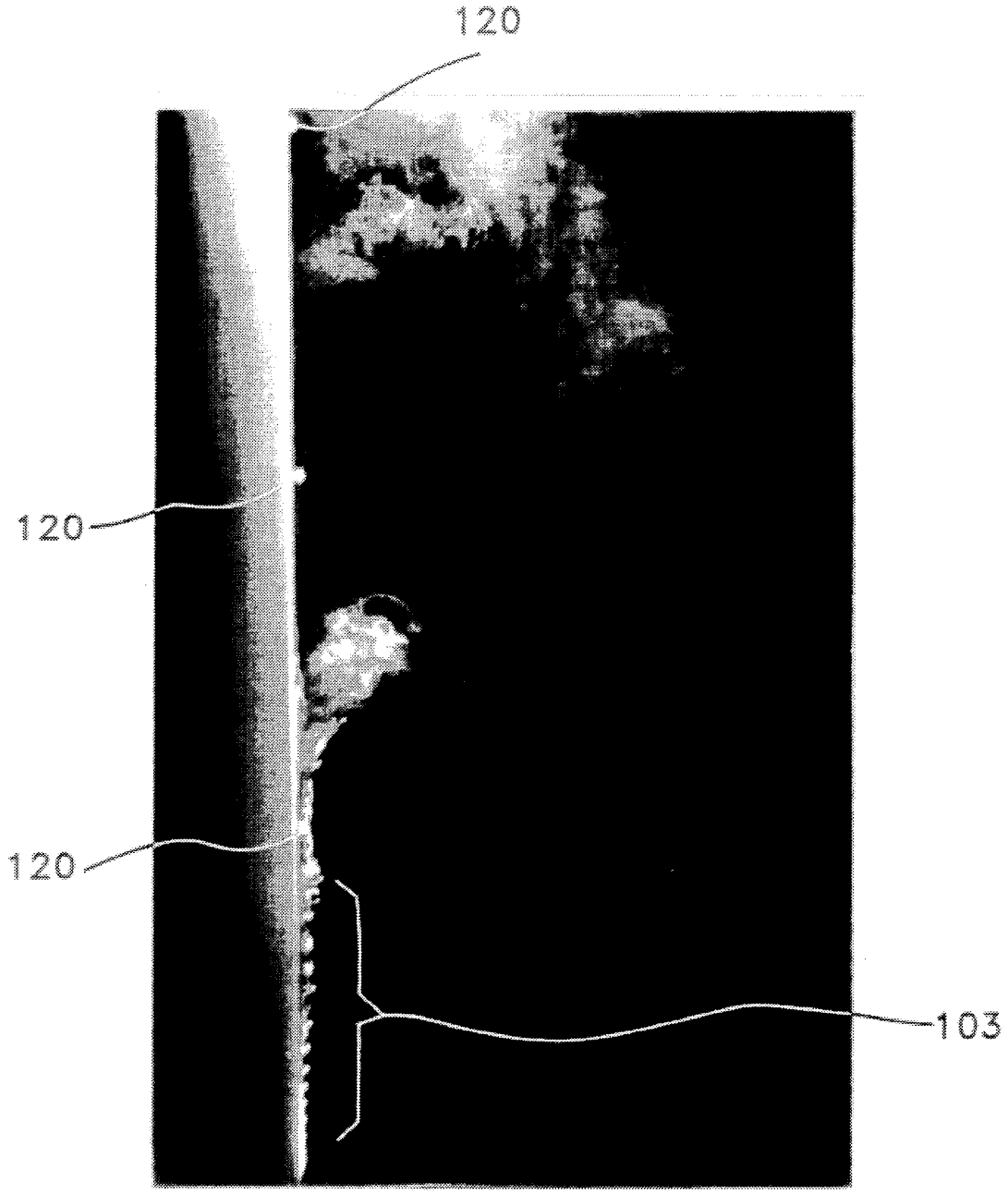

FIG. 2*a* is a perspective view of a jet excitation system according to an alternative embodiment, for heat and mass transport from a moving sheet of material;

FIG. 3 is a schematic representation of a jet excitation system and its placement according to the present invention in side elevation view as installed adjacent a planar surface;

FIG. 4 is a cross-sectional view taken along line 4—4 of FIG. 3 showing the jet excitation mechanism comprising a rotating disk installed in a ventilation duct, and a perspective view of the motor rotating the disk;

FIG. 5 is a side view of the diffuser having a wire positioned across the width of the nozzle;

FIG. 6 is a plan view of the diffuser having a wire positioned across the width of the nozzle and through the adjacent wall;

FIG. 7 displays smoke generated outside of a wall jet using the wire shown in FIG. 5, and visualized using high-speed photography with film speeds at 1/6400 second having a Strouhal number of 0.000;

FIG. 8 displays smoke having regular vortices generated outside of a wall jet using the wire shown in FIG. 5, and visualized using high-speed photography with film speeds at 1/6400 second having a Strouhal number of 0.000;

FIG. 9 displays smoke having irregular vortices generated outside of a wall jet using the wire shown in FIG. 5, and visualized using high-speed photography with film speeds at 1/6400 second having a Strouhal number of 0.000;

FIG. 10 displays smoke generated outside of a wall jet using the wire shown in FIG. 5, and visualized using high-speed photography with film speeds at 1/6400 second having a Strouhal number of 0.028;

FIG. 11 displays smoke generated outside of a wall jet using the wire shown in FIG. 5, and visualized using high-speed photography with film speeds at 1/6400 second having a Strouhal number of 0.056;

FIG. 12 displays smoke generated outside of a wall jet using the wire shown in FIG. 5, and visualized using high-speed photography with film speeds at 1/6400 second having a Strouhal number of 0.112;

FIG. 13 displays a typical visualization of the smoke particles injected into the boundary layer near the outlet for the jet through the hole in the wall, that the wire shown in FIG. 5 traverses, and visualized using high-speed photography with film speeds at 1/6400 second having a Strouhal number of 0.000;

FIG. 14 displays a typical visualization of the smoke particles injected into the boundary layer near the outlet for the jet through the hole in the wall, that the wire shown in FIG. 5 traverses, and visualized using high-speed photography with film speeds at 1/6400 second having a Strouhal number of 0.028;

FIG. 15 displays a typical visualization of the smoke particles injected into the boundary layer near the outlet for the jet through the hole in the wall, that the wire shown in FIG. 5 traverses, and visualized using high-speed photography with film speeds at 1/6400 second having a Strouhal number of 0.056;

FIG. 16 displays a typical visualization of the smoke particles injected into the boundary layer near the outlet for the jet through the hole in the wall, that the wire shown in FIG. 5 traverses, and visualized using high-speed photography with film speeds at 1/6400 second having a Strouhal number of 0.112.

DETAILED DESCRIPTION OF THE PREFERRED EMBODIMENT

The preferred method of simultaneously enhancing the natural instabilities in the boundary layer and in the free shear layer of a wall jet according to this invention may be accomplished with the use of a pulsator mechanism 30 similar to that shown in FIG. 2, and described in U.S. Pat. No. 5,338,254 incorporated herein by reference. It comprises positioning a pulsator mechanism 30 in an air delivery duct 32 upstream from a diffuser 34 for imparting periodic pressure pulsations to an air steam or flow 36 that is being delivered to a plane surface 100, such as a sheet of paper, textile, window, or a ceiling or wall of a room. The pressure pulsations in the air flow 36 simultaneously enhance the natural instabilities in the boundary layer 118, as shown in FIG. 3, and the free shear layer 114 which form as the jet 98 of air emerges from the diffuser 34 and attaches to plane surface 100 as will be described in more detail below. Essentially, however, pulsing the air stream 36 at a periodic frequency causes significant growth of instabilities in boundary layer 118 that ejects flow from boundary layer 118 into the free shear layer 114 of the jet 98 while surrounding fluid is brought into direct contact with plane surface 100 as a result of forced velocity fluctuations, thereby increasing heat and mass transfer from the plane surface 100 and increasing mixing of the ambient air with the jet 98. While jet 98 is shown flowing vertically the jet may also be positioned to flow horizontally, as shown in FIG. 2*a*.

The pulsator mechanism 30 preferably, although not necessarily, comprises a valve 38 positioned in the duct 32 for alternately occluding and opening the duct 32 to a flow of supply air 36. The supply air 36 may be from a conventional forced-air HVAC system, fan, or other source of fresh, heated, or cooled air (not shown), as will be readily understood by persons skilled in the art. The valve 38 illustrated in FIG. 2, is in the form of a butterfly valve or damper with a disk 40 mounted on a diametral rotatable shaft 42, which extends diametrically through the duct 32. The disk 40 can be either rotated or oscillated on the shaft 42 to alternately occlude and open the duct 32 to the flow of air 36.

The pulsating mechanism 30, illustrated in FIG. 2, includes an enlarged section of duct 32, which forms a valve housing 44. Valve housing 44 may also be formed in a section of duct 32 which is not enlarged. The shaft 42 extends diametrically through the valve housing 44 and is journaled for rotation in bearings 46, 48 mounted in opposite sides of valve housing 44, as best seen in FIG. 4. The disk 40 can be fastened to shaft 42 with appropriate fasteners, such as screws 50, 52, also shown in FIG. 4.

Referring to FIGS. 2, 3, and 4, the disk 40 of valve 38 is rotated, as indicted by arrow 54, about an axis 56 defined by shaft 42 to periodically occlude and open the duct 32 to air flow 36. When the disk 40 is rotated to a plane perpendicular to the longitudinal axis of duct 32, it occludes duct 32, and when it rotates an additional 90 degrees to a plane parallel to the longitudinal axis of the duct 32, as illustrated in broken lines 40' in FIG. 3, the duct 32 is completely open. Of course degrees of partial occlusion and openness occur at degrees of rotation between those two extremes. When the duct 32 is occluded by disk 40, air flow is restricted, or reduced, in the connecting portion 33 of duct 32 beyond the valve 38. On the other hand, when the disk 40 is in the open position 40', the full flow and pressure of air flow 36 is transmitted into the connecting portion 33. The result is a sequence of pressure fronts and rarefaction, thus pressure pluses, of the air flow 60 into diffuser 34. Of course a smaller disk 40 in the same size housing 44 would result in only partial occlusion of duct 32, thus lower amplitude pressure pulses, if desired. However, as the percent of occlusion decreases, the frequency needed to achieve the same effect increases.

The shaft 42 and disk 40 are rotated by a pulley 62 mounted on shaft 42 outside housing 44 and driven by an electric motor 64 connected to pulley 62 by a motor pulley 66 and belt 68. A variable speed controller 70 is provided to adjust angular velocity of the rotating disk, thus to adjust the period and frequency of the pressure pulses in the air stream 60.

As mentioned above, instead of rotating disk 40, it could also be oscillated between the occluded and open positions. A wide variety of actuators, such as a crank, pneumatic cylinder, solenoid, or the like could be used to impact such oscillating motion to disk 40. Furthermore, other mechanisms, such as oscillating shutters, fan blades, gates, or any number of other mechanism could be used to create the pulsed air flow required to practice this invention.

The intermediate connecting portion 33 of duct 32 directs the pulsed air flow 60 into an enlarged plenum 72 of diffuser 34. To help equalize air flow throughout plenum 72, the pulsed stream of air 60 is directed via forked duct sections 74, 76 of duct 32 into respective ends 78, 80 of plenum 72. Also, as illustrated in FIG. 3, a plurality of turning vanes 82 and flow conditioning screens 84 can be used to minimize and dissipate any turbulent structures in the air flow through the plenum 72 and to further ensure equal distribution of air flow and pressure throughout plenum 72. To ensure a highly uniform outlet velocity a curved extension 86 was inserted into the nozzle outlet 88. Curved extension 86 has a radius of curvature large enough to prohibit the boundary layer 118 forming on the surface 87 of extension 86 from separating thus avoiding a region of reverse flow that would produce a highly nonuniform outlet velocity. The nozzle outlet 88 of the diffuser 34 is preferably, but not necessarily, an elongated, narrow slot, positioned adjacent to plane surface 100, so that a jet 98 emerging from nozzle outlet 88 impinges and attaches to and spreads over the plane surface 100.

As best illustrated in FIG. 2, the plenum 72 of diffuser 34 narrows to a neck 90 just before the slotted opening on nozzle 88. Flanges 92 around the slotted nozzle 88 facilitate mounting the nozzle in a position so that the emerging jet 98 impinges and attaches to plane surface 100. Flange 92 also provides structural integrity to the nozzle 88.

The jet 98 of air emerging from the nozzle 88 attaches to and spreads out over the plane surface 100. A natural occurrence upon the introduction of a jet J at some constant, nonpulsed velocity along a plane surface S is the formation of a boundary layer 18 and a free shear layer 14 along the plane surface S and ambient air A, respectively, as discussed previously and illustrated in FIG. 1.

It has been found according to this invention that periodic large amplitude, low-frequency disturbances of the air flow 36 in duct 32 causes a substantial excitation of the jet 98 and results in substantially larger and more active vortices 102 and 103 in the free shear layer 114 and boundary layer 118, respectively. This enhanced instability increases the entrainment of surrounding fluid and minimizes the thickness of the boundary layer 118, thus resulting in greater transport of mass and heat between the surrounding fluid, the free shear layer 114, the boundary layer 118, and the plane surface 100.

The pulse rate or frequency of the pulsating air flow 60 in duct section 33 can be varied or adjusted to enhance or diminish the instabilities of jet 98 by varying the speed of rotation of the disk 40 in valve 38. A variable speed control 70 (FIG. 2) can be provided for this purpose. Each one-half revolution of the disk 40 places the disk at its duct-occluding position once and at its open duct position once, thus causing one pulse. A full revolution of disk 40, therefore, causes two pulses in the duct section 33 and diffuser 34. Of course, other valve 38 actuation mechanisms, such as oscillators, pneumatic actuators, and the like, as discussed above, can be regulated in whatever manner is appropriate to the valve structure and actuator used to produce the desired pulse rate according to this invention.

In general, however, pulsing the air flow 60 at a frequency in the range of 1 to 50 Hz can produce significant minimization of boundary layer 118, with the most substantial heat and mass transport benefits resulting from pulse frequencies with a Strouhal number of 0.056 or 0.112, in the subaudible range below about 20 Hz for a Reynolds number of about 4500. The Strouhal number is defined as the frequency times the width of the nozzle divided by the exit velocity.

In an alternate embodiment, shown in FIG. 2*a*, diffuser 234 may be positioned so that emerging jet 298 flows horizontally. The pulsator mechanism, as discussed previously, is positioned in an air delivery duct (not shown) upstream from a diffuser 234 for imparting periodic pulsations to an air stream or flow that is being delivered to a plane surface 200 of a sheet 202 of material such as a sheet of paper, textile, metal or glass. Sheet 202 prior to being rolled into roll 210 passed over an assembly of reels 204, 206 and 208. Diffuser 234 is positioned above reel 204 so that as the sheet 202 moves toward the diffuser 234, emerging jet 298 attaches to the plane surface 200 and transports heat and mass from the plane surface 200 prior to sheet 202 being rolled up.

EXAMPLE

An example jet excitation system 28 substantially as described above, was set up and operated to observe jet excitation results. The nozzle 88 was designed to approximate actual diffuser geometries, but with a uniform outlet velocity. The nozzle outlet was 2.16 cm wide by 119 cm long, the width and length being the transverse and longitudinal dimensions, respectively. The final aspect ratio, i.e., nozzle length/nozzle width, was 55. A seven inch curved extension 86, was inserted into the neck 90 through the nozzle 88. A vertical discharge orientation were used, so that buoyancy forces were minimized. For nonisothermal cases the air was chilled by a cooling coil (not shown) located on the downstream side of a squirrel cage blower (not shown). The diffuser 34 was positioned adjacent a laminated wall, so that the emerging jet 98 would attach to the plane surface 100 of the wall. The laminated wall was made from a piece of rigid insulation with a surface of hard, thin, synthetic material similar in texture to a common cardboard surface but smoother and harder. The air flow 36 in duct 32 was supplied from a squirrel cage blower located in an adjacent room via a 23.0 cm galvanized duct 32. The pulsator mechanism 30 was located 5.0 m upstream of the nozzle 88. In order to prevent the transmission of mechanical vibration from the pulsator mechanism 30 to the nozzle 88, sections of flexible duct 74 and 76, shown in FIG. 2, were used immediately downstream of the pulsator mechanism 30. An optical tachometer (not shown) with a digital readout detected the rotational speed of the disk 40 directly from the pulley 62. A synchronous belt 68 and pulleys 62 and 66 in the form of sprockets were used to prevent slippage. The motor 64 could be varied in speed from 0 to about 1680 revolutions per minute. The turning vanes 82 and screens 84 dissipated any turbulent structures introduced to the air flow 60 by the pulsator mechanism 30 to ensure that the fluid structures which had been created by and separated from the pulsator mechanism 30 were dispersed.

Hot wire anemometry (not shown) was used to collect flow information. Since disturbance frequencies ranged from 4 to 16 Hz, a sampling frequency of 1000 Hz was chosen to provide a power spectral density range of 0.5 to 500 Hz, thereby allowing a sampling of higher harmonies. A sampling time of 120 seconds provided one hundred twenty occurrences at the low end of 1.0 Hz, the quarter harmonic of 4 Hz. Velocity histories produced by each test were decomposed to determine the mean and periodic velocities, the peak velocity fluctuations, and the turbulence intensity for each test point and condition. The mean velocities from groups of individual test points produced the velocity profiles, which showed the shape and mixing characteristics of the jet.

High-speed photographic techniques were used to visualize the structures by which mixing of the jet 98 occurs. By producing smoke at or adjacent the outlet 88 and photographing, the actual mixing of the jet 98 with the ambient air and the decrease in the thickness of the boundary layer 118 can be seen. Wire 94, shown in FIGS. 5 and 6, is stretched across the width of nozzle 88 and an oil is then applied to wire 94. Applying a current to wire 94 results in the heating of the oil and smoke is thereby produced. The high frequency and rapid occurrence of the physical events which result in mixing and the minimization of the boundary layer 118 required that short exposures be taken to visualize these events. FIGS. 7–16 are still photographs of the smoke in the jet 98 taken with an exposure of 1/6400 seconds.

The visualization of the natural jet J reveals that small-scale vortical structures 22, Kelvin-Helmholtz instabilities, roll up in the free shear layer 14 at the turbulent interface.

Figure 1:
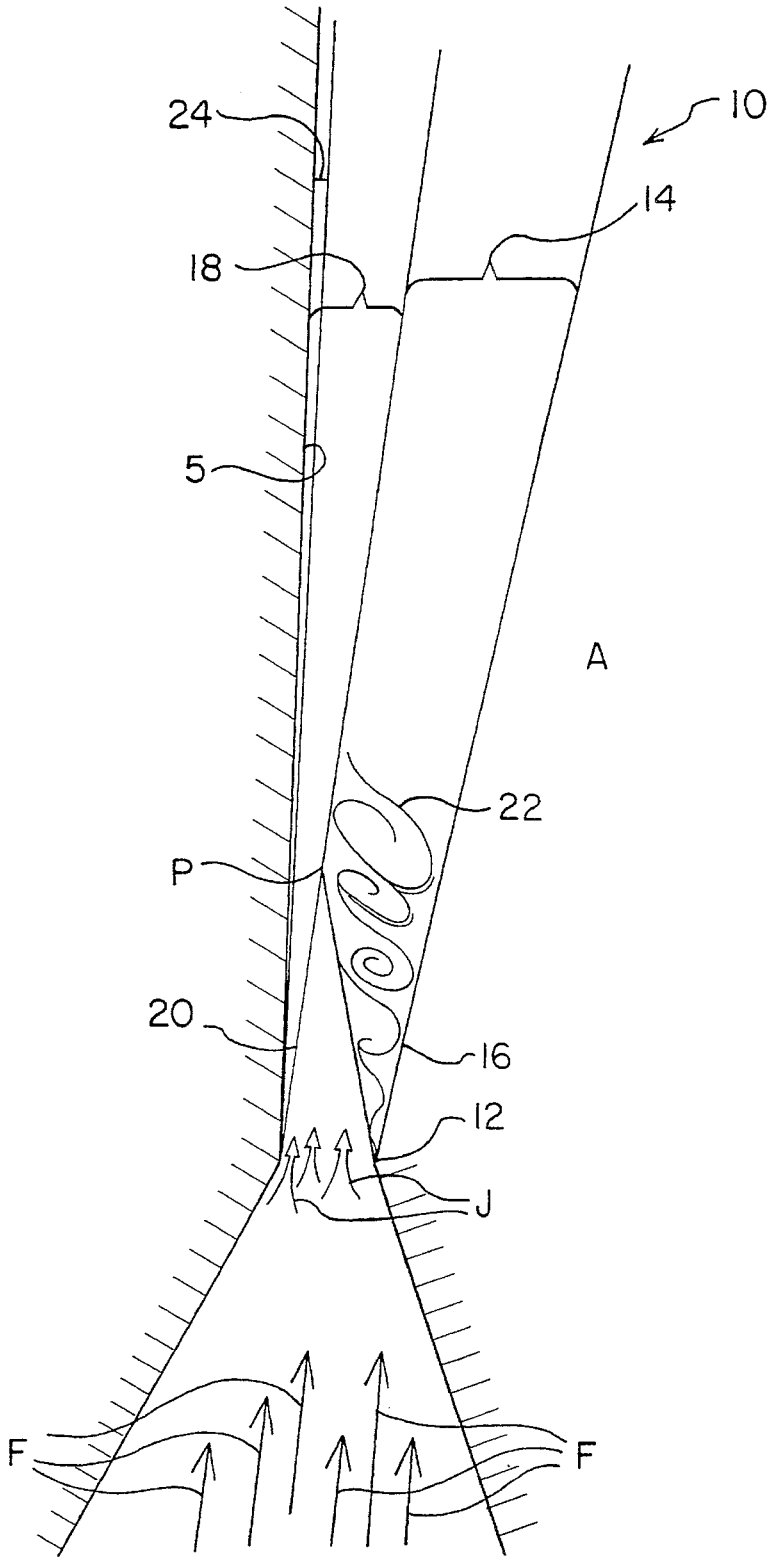
FIG. 1 (PRIOR ART)

FIG. 7 shows a typical visualization of the natural jet J schematically represented in FIG. 1. The spherical position markers 120 are placed to indicate axial distance in increments of five nozzle widths. They were positioned in a different longitudinal plane than the plane in which the smoke was generated in order to not affect the flow in the visualized plane. The high-speed rims verify that the vortices 22 roll up in the free shear layer 14 during the first four to five nozzle widths at which point they begin to dissipate. The size and frequency of natural vortices is irregular and the interaction between them, i.e., pairing and coalescing, can, but does not always occur. For example, a vortex array, shown in FIG. 8, forms in the free shear layer 14 from about one and one-half to three nozzle widths and is fairly regular with the vortices 22 being nearly evenly spaced and comparable in size. In contrast to this, the vortices 22 in the same region (shown in FIG. 9) are coalescing and forming into larger structures. The relatively large structure 30 at about three and one-half nozzle widths is the result of the coalescing of smaller vortices 22, three of which can be seen interacting at about two nozzle widths. This process can be seen repeatedly in the high-speed films and usually occurs by an axial distance of about five nozzle widths.

Visualization of the Pulsed Wall Jet

The structural formation and interaction differed significantly between the disturbance frequencies. The flow was affected by all of the frequencies but the periodic formation of large scale structures at the disturbance frequency was not as obvious for the jet pulsed at Str=0.028 as it was for the higher disturbance frequencies. The structures produced by pulsing the jet 98 at Str=0.028 did not produce the coherent vortical structures that were observed for disturbances of the higher frequencies. Interaction of the large-scale structures occurred frequently, but not always, for the jet pulsed at Str=0.028 or Str=0.056.

Increased instability in the boundary layer 118 was also observed in the pulsed jet. The formation of vortices or instability structures 103 in this region was most obvious for the jet pulsed at Str=0.056, shown in FIG. 15. The particles released in the boundary layer 118 interacted with the fluid in the free shear layer 114 more for the pulsed jet 98 than for the natural jet J. Interaction of the instability structures 103 (not shown) in the boundary layer 118 with the large-scale structures 102 in the free shear layer 114 was clear for the jet pulsed at Str=0.056, (shown in FIG. 11), less significant for the jet pulsed at Str=0.112 (shown in FIG. 12) and not noticeable for the jet pulsed at Str=0.028 (shown in FIG. 10). As shown in FIG. 11, the large-scale structure 102 is no longer circular, but instead is deformed. This is a result of the periodic instability of boundary layer 118 as the instability structures 103 (not shown) propogate across the jet 98 to deform the large-scale structure 102 in the free shear layer 114 leading to the breakdown of large scale structure 102 and increased mixing.

The Free Mixing Layer

The structures that entrain mass in a wall jet are the vortices 102 that form in the free shear layer 114. The larger these vortices 102 are the greater the mass of the surrounding fluid that is entrained. Once the structures have formed interaction between them can affect the size of the structures and the rate of viscous dissipation of the structures but not entrain additional mass. The visualization of the free shear layer 114 showed that the large amplitude, low-frequency disturbances produced large-scale vortices 102 in the free shear layer 114 that showed both interaction and non-interaction depending on the disturbance frequency.

The flow visualization showed that, similar to the hotwire results, disturbances at Str=0.028 affected the turbulence structures of the jet 98 but to a much lesser degree than the higher frequencies that were tested. This can be seen by comparing the jet 98 exposed to disturbances of Str=0.028, shown in FIG. 10, to the natural jet J which was shown in FIG. 7.

The flow field in the free shear layer 114 over the first 12 nozzle widths is composed of vortical structures which are larger and more interactive than those of the natural jet J. The high speed film showed that these structures were formed by the coalescing of smaller structures. A large structure formed once for each cycle of velocity fluctuation. This structure continued to grow by coalescing with some of the smaller-scale structures which formed in its wake. By about 10 nozzle widths the structure 122 had grown to its largest size and began to dissipate. This structure 122 eventually dissipated completely at which point complete mixing had occurred.

FIGS. 11 and 12 show typical structures in the near field of the jet 98 pulsed at Str=0.056 and Str=0.112, respectively. The flow visualization showed clearly that the velocity fluctuations at Str=0.056 and Str=0.112 produced large vortices at the point in the velocity fluctuation where the velocity was accelerating from its minimum. This vortex then captured surrounding fluid and carried it downstream. The large-scale vortices coalesced into a larger vortex. The beginning of this process can be seen in FIG. 12 between the two structures 122 and 120 at 10 and 13 nozzle widths, respectively. The structure 122 at 10 nozzle widths is in the wake of the structure 124 at 13 nozzle widths and is being drawn into it in a clockwise direction.

The streakline 126 formed by the smoke particles generated farthest away from the wall reveals the dynamics of the jet 98 boundary. As the vortex forms in the first 5 nozzle widths it pulls fluid into itself by transport of vorticity through viscosity. The streakline 126 gets stretched around the vortex with most of the particles on the downstream side being formed against the wall in the wake of the preceding vortex and those adjacent to the forming vortex being drawn into it. In this manner the jet 98 boundary fluctuates perpendicular to the wall.

The Wall Layer

Flow visualization showed that the interaction between the quiescent fluid and the wall was greater for the jet pulsed 98 at Str=0.028 and much greater for the jet pulsed 98 at Str=0.056 and Str=0.112 than for the natural wall jet J. FIG. 13 shows a typical visualization of the smoke particles 128 released into the wall layer near the outlet for the natural wall jet J. The particles have become diffused by an axial distance of 15 nozzle widths and some of them have been transported into the free shear layer 14. For the jet pulsed at Str=0.028, shown in FIG. 14, at the same axial distance of 15 nozzle widths the particles have been transported farther away from the wall by the vortical structure generated than the outlet velocity fluctuation produced.

For the jet pulsed at Str=0.056 the particles at 15 nozzle widths have been transported well into the free shear layer 114 by the large-scale vortex 130, as shown in FIG. 15. This photograph demonstrates the increased mass and vorticity transport in the pulsed jet 98, particularly when compared to the natural jet J in FIG. 13. Also clearly visible is the formation of instability structures 103 in the boundary layer 118 interface over the first 5 nozzle widths.

For the jet pulsed at Str=0.112 the structure is much like that at Str=0.056 except that the phenomena produced by the artificial vortical structures occur at twice the frequency. The instability structures 103 are approximately of the same scale as can be seen in FIGS. 16. Again instabilities can be seen forming in the boundary layer 118 leading to the ejection of boundary layer 118 fluid into the free shear layer 114.

While the fluid used in the above description was an air stream, other gases or liquids may also be utilized by the present invention.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

The embodiments of the invention in which an exclusive property or privilege is claimed are defined as follows:

1. A method for enhancing the transport of heat and mass from a solid surface by minimizing the thickness of the boundary, layer of an air flow that attaches to and spreads out over the surface of said solid comprising the steps of imparting periodic pressure pulsations to the air in the plenum, and impinging said pulsated air on said solid surface.

2. The method of claim 1, including the steps of imparting large-amplitude, low-frequency disturbances to the air flow by directing the air flow through a confined flow path before impinging the air on said solid surface, and sequentially occluding and opening the flow path.

3. The method of claim 2, including the steps of positioning a disk in the confined flow path in an orientation such that is occludes the flow path in an orientation such that it occludes the flow path in a first position and opens the flow path in a second position.

4. The method of claim 3, including the steps of mounting said disk on a rotatable axle in such a manner that said disk is rotatable repeatedly about an axis defined by said shaft through said first position and said second position, and rotating said disk about said axis.

5. A drying and cooling apparatus for transporting heat and mass from a solid surface in contact with ambient air, comprising:

a source of air under a higher pressure than the ambient air in contact with the solid surface;

conduit means extending from said source to said solid surface for confining, directing and impinging a flow of the air from said source to and on said solid surface; and pulsator means positioned in the flow of the air between said source and said solid surface for imparting a pulsating variation in pressure in said flow of the air, wherein said pulsator means includes a valve housing for confining the flow of air in a direction that defines a flow axis, and gate means position in said value housing for sequentially occluding and opening said valve housing to the flow of said air, said gate means including a disk mounted rotatably in said valve housing in a manner that defines an axis of rotation that extends diametrically through said disk and transversely through said valve housing to the flow of air and a second position that is open to the flow of air through the valve body.

6. The drying and cooling apparatus of claim 5, including drive means connected to said disk for rotating said disk between said first and said second position.

7. The drying and cooling apparatus of claim 6, including speed control means connected to said drive means for varying the speed of rotation of said disk.

8. The drying and cooling apparatus of claim 7, wherein said conduit means includes nozzle means for impinging said flow of air on said surface.

9. The drying and cooling apparatus of claim 8, wherein said conduit means includes an enlarged plenum positioned in said conduit means immediately upstream of said nozzle means for equalizing distribution of the flow of air uniformly through the nozzle means.

10. The drying and cooling apparatus of claim 9, wherein said pulsator means is positioned upstream of said plenum in said flow of air.

11. The drying and cooling apparatus of claim 10, wherein said nozzle means includes a narrow, elongated opening from said plenum positioned adjacent said solid surface.

12. The drying and cooling apparatus of claim 11, wherein said solid surface is transparent.

13. The drying and cooling apparatus of claim 12, wherein said transparent solid surface is an automobile windshield.

14. The drying and cooling apparatus of claim 11, wherein said solid surface is a sheet of paper.

15. The drying and cooling apparatus of claim 11, wherein said solid surface is a textile.

16. The drying and cooling apparatus of claim 11, wherein said solid surface is a sheet of processed glass.

17. A method for enhancing the natural instabilities in the boundary layer and free shear layer of an air flow that is expelled from a plenum in a manner that the air flow impinges upon and attaches to a plane surface, including the step of imparting periodic pressure pulsations to the air in the plenum to enhance the instabilities in the boundary layer and the free shear layer.

18. The method of claim 17, wherein said periodic pressure pulsations result from large-amplitude, low frequency disturbances.

19. The method of claim 17, including the step of pulsing the air at a frequency in the range of about 4 to 16 hertz.

20. The method of claim 17, including the step of pulsing the air at a Strouhal number in the range of 0.028 to 0.112.

* * * * *